US008349778B2

(12) United States Patent
Guinther et al.

(10) Patent No.: US 8,349,778 B2
(45) Date of Patent: Jan. 8, 2013

(54) LUBRICATING COMPOSITIONS HAVING IMPROVED FRICTION PROPERTIES

(75) Inventors: Gregory H. Guinther, Richmond, VA (US); John T. Loper, Richmond, VA (US); Roger M. Sheets, Pagosa Springs, CO (US)

(73) Assignee: Afton Chemical Corporation, Richmond, VA (US)

( * ) Notice: Subject to any disclaimer, the term of this patent is extended or adjusted under 35 U.S.C. 154(b) by 200 days.

(21) Appl. No.: 11/839,996

(22) Filed: Aug. 16, 2007

(65) Prior Publication Data

US 2009/0048131 A1 Feb. 19, 2009

(51) Int. Cl.
*C10M 137/00* (2006.01)
*C09K 3/00* (2006.01)
*F01M 9/00* (2006.01)

(52) U.S. Cl. ..... 508/430; 123/196 R; 252/182.35

(58) Field of Classification Search ..... 508/591, 508/408, 579, 228, 430; 123/196 R; 252/182.35
See application file for complete search history.

(56) References Cited

U.S. PATENT DOCUMENTS

| | | | | |
|---|---|---|---|---|
| 2,063,629 | A | 12/1936 | Salzberg et al. | |
| 2,224,695 | A | 12/1940 | Prutton | |
| 2,447,288 | A | 8/1948 | Smith et al. | |
| 2,616,905 | A | 11/1952 | Asseff et al. | |
| 2,945,749 | A | 7/1960 | Andress | |
| 3,513,093 | A * | 5/1970 | LeSuer | 508/228 |
| 3,826,745 | A | 7/1974 | Ryer et al. | |
| 3,984,448 | A | 10/1976 | Lippsmeier | |
| 4,431,552 | A | 2/1984 | Salentine | |
| 4,536,308 | A | 8/1985 | Pehler et al. | |
| 4,661,271 | A | 4/1987 | Horodysky et al. | |
| 4,943,672 | A | 7/1990 | Hamner et al. | |
| 5,354,484 | A | 10/1994 | Schwind et al. | |
| 5,387,352 | A | 2/1995 | Iyer | |
| 5,391,307 | A | 2/1995 | Yamazaki et al. | |
| 5,531,911 | A * | 7/1996 | Adams et al. | 508/408 |
| 5,763,372 | A | 6/1998 | Tersigni et al. | |
| 5,843,873 | A | 12/1998 | Butke et al. | |
| 5,882,505 | A | 3/1999 | Wittenbrink et al. | |
| 6,013,171 | A | 1/2000 | Cook et al. | |
| 6,080,301 | A | 6/2000 | Berlowitz et al. | |
| 6,096,940 | A | 8/2000 | Wittenbrink et al. | |
| 6,103,099 | A | 8/2000 | Wittenbrink et al. | |
| 6,165,949 | A | 12/2000 | Berlowitz et al. | |
| 6,180,575 | B1 | 1/2001 | Nipe | |
| 6,500,786 | B1 | 12/2002 | Hartley et al. | |
| 6,656,887 | B2 | 12/2003 | Yagishita et al. | |
| 6,992,049 | B2 * | 1/2006 | Deckman et al. | 508/591 |
| 2002/0086802 | A1 | 7/2002 | Cain | |
| 2004/0176260 | A1 | 9/2004 | Shirahama et al. | |
| 2010/0204075 | A1 * | 8/2010 | da Costa | 508/579 |

FOREIGN PATENT DOCUMENTS

| | | |
|---|---|---|
| EP | 1227145 | 7/2002 |
| EP | 1437396 | 7/2004 |
| EP | 1686141 | 8/2006 |
| WO | WO 87/07638 | 12/1987 |
| WO | 9714770 | 4/1997 |

OTHER PUBLICATIONS

Petrov et al., Zhurnal Obshchei Khimii, vol. 31, No. 8, pp. 2508-2515 (1961).

C. Bovington et al., "Predicting Sequence Vi and Via Fuel Economy from Laboratory Bech Tests", SAW Paper No. 961142 (Jan. 1996).

Mark T. Devlin, "Improved Understanding of Axle Oil Rheology Effects on Torque Transfer Efficiency and Axle Oil Operating Termperature", SAE Paper No. 2003-01-1972.

* cited by examiner

*Primary Examiner* — James Goloboy
*Assistant Examiner* — Chantel Graham
(74) *Attorney, Agent, or Firm* — Luedeka Neely Group, P.C.

(57) ABSTRACT

The present invention provides an additive composition comprising (a) at least one ash-containing phosphorus compound prepared by a primary or secondary alcohol or mixtures thereof, and (b) a salt of at least one hydrocarbylamine and at least one hydrocarbyl acid phosphate. Further, the present invention provides a lubricating composition comprising (a) at least one ash-containing phosphorus compound prepared by a primary or secondary alcohol or mixtures thereof, and (b) a salt of at least one hydrocarbylamine and at least one hydrocarbyl acid phosphate, and methods of use thereof.

11 Claims, No Drawings

LUBRICATING COMPOSITIONS HAVING IMPROVED FRICTION PROPERTIES

DESCRIPTION OF THE DISCLOSURE

1. Field of the Disclosure

The present disclosure is directed to additive and lubricating compositions and methods for use thereof. More particularly, this invention is directed to an additive composition comprising (a) at least one ash-containing phosphorus compound prepared by a primary or secondary alcohol or mixtures thereof, and (b) a salt of at least one hydrocarbylamine and at least one hydrocarbyl acid phosphate.

2. Background of the Disclosure

In recent years, there has been growing concern to produce energy-efficient lubricated components. Moreover, modern engine oil specifications require lubricants to demonstrate fuel efficiency in standardized engine tests. The thickness and frictional characteristics of lubricant films are known to affect the fuel economy properties of oils.

Lubricant films have many types of frictional characteristics, including boundary friction and thin film friction. Thin-film friction is the frictional force generated from fluid, such as a lubricant, pushing between two surfaces, wherein the distance between the two surfaces is very narrow. Boundary friction is the frictional force that exists when rubbing surfaces in a machine, such as an engine, gear system or transmission, come in contact. Such frictional forces retard the motion of the surfaces, which in turn reduces the efficiency of a machine.

It is known that different additives normally present in a lubricant composition form films of different thicknesses, which can have an effect on at least one of boundary friction and thin-film friction. Moreover, some additives have a narrow range of conditions wherein they provide reduced friction properties to a lubricant composition. Further, some additives, such as zinc dialkyl dithiophosphate (ZDDP) are known to increase thin-film friction.

However, ZDDP is known to provide a source of phosphorus that may cause significant problems with exhaust catalytic converters and oxygen sensors when the phosphorus from combusted oil forms an impermeable glaze that may mask precious metal sites. As a result, there is pressure by the automakers to control and/or reduce the amount of ZDDP used in engine oils to facilitate longer converter and oxygen sensor life, and to reduce the manufacturer's initial costs of converters through lower precious metal content. Yet while a reduction in the phosphorus content of the lubricating oils may improve catalytic converter life or efficiency, the benefits of additives such as ZDDP for friction control and wear protection may not be conveniently or effectively matched by alternative additives.

What is needed is a lubricating composition that is inexpensive and can provide at least one of reduced boundary friction, reduced thin-film friction, and increased fuel economy, while maintaining satisfactory wear protection.

SUMMARY OF THE DISCLOSURE

In accordance with the disclosure, there is provided an additive composition comprising (a) at least one ash-containing phosphorus compound prepared by a primary or secondary alcohol or mixtures thereof, and (b) a salt of at least one hydrocarbylamine and at least one hydrocarbyl acid phosphate.

In an aspect, there is provided a lubricating composition comprising a major amount of a base oil; and a minor amount of an additive composition comprising (a) at least one ash-containing phosphorus compound prepared by a primary or secondary alcohol or mixtures thereof, and (b) a salt of at least one hydrocarbylamine and at least one hydrocarbyl acid phosphate.

In another aspect, there is provided a method of reducing boundary friction of a fluid between surfaces, said method comprising providing to the surfaces a lubricating composition comprising a major amount of a base oil; and a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate.

Further, there is provided a method of reducing thin-film friction of a fluid between surfaces, said method comprising providing to the fluid a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate.

Additionally, there is provided a method of increasing fuel efficiency in a vehicle, said method comprising providing to the vehicle a lubricating composition comprising a major amount of a base oil; and a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate.

In yet another aspect, there is provided a method of lubricating at least one moving part of a machine, said method comprising contacting at least one moving part with a lubricating composition comprising a major amount of a base oil; and a minor amount of an a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate.

In a further aspect, there is provided a method for improving wear protection in a vehicle, said method comprising providing to the vehicle a lubricating composition comprising a major amount of a base oil; and a minor amount of a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate.

Additional objects and advantages of the disclosure will be set forth in part in the description which follows, and/or can be learned by practice of the disclosure. The objects and advantages of the disclosure will be realized and attained by means of the elements and combinations particularly pointed out in the appended claims.

It is to be understood that both the foregoing general description and the following detailed description are exemplary and explanatory only and are not restrictive of the disclosure, as claimed.

DESCRIPTION OF THE EMBODIMENTS

The present disclosure generally relates to an additive composition comprising (a) at least one ash-containing phosphorus compound prepared by a primary or secondary alcohol or mixtures thereof, and (b) a salt of at least one hydrocarbylamine and at least one hydrocarbyl acid phosphate. In an embodiment, the additive composition can be formulated into a lubricating composition. The additive composition and lubricating composition can provide at least one of reduced boundary friction, reduced thin-film friction, and increased fuel economy, without the presence of organic and inorganic friction modifiers.

As used herein, the term "major amount" is understood to mean an amount greater than or equal to 50 wt. %, for example from about 80 to about 98 wt. % relative to the total weight of the composition. Moreover, as used herein, the term "minor amount" is understood to mean an amount less than 50 wt. % relative to the total weight of the composition.

As used herein, the terms "hydrocarbon" or "hydrocarbyl" mean that the moiety being described has predominantly hydrocarbon character within the context of this invention. These include moieties that are purely hydrocarbon in nature, that is, they contain only carbon and hydrogen. They can also include moieties containing substituents or atoms which do not alter the predominantly hydrocarbon character of the moiety. Such substituents can include halo-, alkoxy-, nitro-, etc. These moieties also can contain hetero atoms. Suitable hetero atoms will be apparent to those skilled in the art and include, for example, sulfur, nitrogen, oxygen, and phosphorus. Therefore, while remaining predominantly hydrocarbon in character within the context of this disclosure, these moieties can contain atoms other than carbon present in a chain or ring otherwise composed of carbon atoms.

As used herein, "aromatic" or "aryl", unless expressly stated otherwise, refers to the typical substituted or unsubstituted non-aliphatic hydrocarbyl or heterocyclic moieties of this class, e.g., a polyunsaturated, typically aromatic, hydrocarbyl cyclical, or heterocyclic, substituent, which can have a single ring or multiple rings (up to three rings) that are fused together or linked covalently. Typical hydrocarbyl aromatic moieties include phenyl, naphthyl, biphenylenyl, phenanthrenyl, phenalenyl, and the like. Such moieties are optionally substituted with one or more hydrocarbyl substituents. Also included are aryl moieties substituted by other aryl moieties, such as biphenyl. Heterocyclic aryl or aromatic moieties refers to unsaturated cyclical moieties containing carbon atoms in the ring and additionally one or more hetero atoms, which are typically oxygen, nitrogen, sulfur and/or phosphorus, such as pyridyl, thienyl, furyl, thiazolyl, pyranyl, pyrrolyl, pyrazolyl, imidazolyl, pyrazinyl, thiazolyl, etc. Such moieties are optionally substituted with one or more substituents such as hydroxy, optionally substituted lower alkyl, optionally substituted lower alkoxy, amino, amide, ester moieties and carbonyl moieties (e.g., aldehyde or ketonic moieties).

As used herein, "alkaryl", unless expressly stated otherwise, refers to an alkyl moiety substituted by the typical substituted or unsubstituted non-aliphatic hydrocarbyl or heterocyclic moieties described above. Typical aryl moieties include phenyl, naphthyl, benzyl, and the like. Such moieties are optionally substituted with one or more substituents such as hydroxy, optionally substituted alkyl, optionally substituted alkoxy, amino, amide, ester moieties and carbonyl moieties (e.g., aldehyde or ketonic moieties).

The compositions disclosed herein can comprise at least one ash-containing phosphorus compound in any effective amount, which can be readily determined by one of ordinary skill in the art depending upon specific requirements and applications. For example, the ash-containing, phosphorus compound can be a dihydrocarbyl dithiophosphate metal salt.

The metal in the dihydrocarbyl dithiophosphate metal can be an alkali or alkaline earth metal, or aluminium, lead, tin, molybdenum, manganese, nickel or copper. Zinc salts can be used, for example.

The metal dihydrocarbyl dithiophosphate salts can be prepared in accordance with known techniques by first forming a dihydrocarbyl dithiophosphoric acid (DDPA), usually by reaction of one or more alcohol or a phenol with $P_2S_5$ and then neutralizing the formed DDPA with a zinc compound. For example, a dithiophosphoric acid can be made by reacting mixtures of primary and secondary alcohols. Alternatively, multiple dithiophosphoric acids can be prepared comprising both hydrocarbyl groups that are entirely secondary in character and hydrocarbyl groups that are entirely primary in character. In an aspect, the dithiophosphoric acids can comprise a combination of about 60 mol % primary alcohol and about 40 mol % secondary alcohol. In yet another aspect, the dithiophosphoric acids can comprise 100 mol % secondary alcohols, or 100 mol % primary alcohols. To make the zinc salt, any basic or neutral zinc compound can be used but the oxides, hydroxides and carbonates are most generally employed.

The metal dihydrocarbyl dithiophosphate salts can be oil-soluble salts of dihydrocarbyl dithiophosphoric acids and can be represented by the following formula: $[(RO)(R^1O)P(S)]_2Z_n$ where R and $R^1$ can be the same or different hydrocarbyl radicals containing from about 1 to about 18, for example from about 2 to about 12, carbon atoms and including radicals such as alkyl, alkenyl, aryl, arylalkyl, alkaryl and cycloaliphatic radicals. In an aspect, R and $R^1$ groups can be alkyl groups of about 2 to about 8 carbon atoms. Thus, the radicals can, for example, be ethyl, n-propyl, i-propyl, n-butyl, i-butyl, sec-butyl, amyl, n-hexyl, i-hexyl, n-octyl, decyl, dodecyl, octadecyl, 2-ethylehexyl, phenyl, butylphenyl, cyclohexyl, methylcyclopentyl, propenyl, and butenyl. In order to obtain oil-solubility, the total number of carbon atoms (i.e. in R and $R^1$ in the dithiophosphoric acid) can generally be 5 or greater.

In an embodiment, the metal dihydrocarbyl dithiophosphate salts can comprise zinc dialkyl dithiophosphates (ZDDP). Examples of commercially available ZDDP compounds that can be used include, but are not limited to HiTEC® 7169, HiTEC® 7197, HiTEC® 680, HiTEC® 659, and HiTEC® 1656, all available from Afton Chemical Corp. of Richmond, Va. Additionally, the metal dihydrocarbyl dithiophosphate salts used herein should be soluble in a final lubricating composition.

The disclosed compositions can also comprise at least one ash-free phosphorus compound. For example, an ash-free phosphorus compound suitable for use herein can include salts of at least one hydrocarbylamine and at least one hydrocarbyl acid phosphate. Examples of such salts can include oil-soluble amine salts of a phosphoric acid ester, such as those taught in U.S. Pat. Nos. 5,354,484 and 5,763,372, the disclosures of which are hereby incorporated by reference. The amine salts of a phosphoric acid ester can be prepared by reacting a phosphoric acid ester with ammonia or a basic nitrogen compound, such as an amine. The salts can be formed separately, and then the salt of the phosphoric acid ester can be added to the lubricating composition.

The phosphoric acid esters useful in preparing the amine salts of the present invention can be characterized by the formula

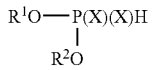

(I)

wherein $R^1$ can be hydrogen or a hydrocarbyl group, $R^2$ can be a hydrocarbyl group, and both X groups can be either O or S.

An exemplary method of preparing compositions containing (I) comprises reacting at least one hydroxy compound of the formula ROH with a phosphorus compound of the formula $P_2X_5$ wherein R can be a hydrocarbyl group and X can be O or S. The phosphorus compounds obtained in this manner can be mixtures of phosphorus compounds, and are generally mixtures of mono- and dihydrocarbyl-substituted phosphoric and/or dithiophosphoric acids depending on a choice of phosphorus reactant (i.e., $P_2O_5$ or $P_2S_5$).

The hydroxy compound used in the preparation of the phosphoric acid esters of this disclosure can be characterized by the formula ROH wherein R can be a hydrocarbyl group. The hydroxy compound reacted with the phosphorus compound can comprise a mixture of hydroxy compounds of the formula ROH wherein the hydrocarbyl group R can contain from about 1 to about 30 carbon atoms. It is necessary, however, that the amine salt of the substituted phosphoric acid ester ultimately prepared is soluble in the lubricating compositions of the present disclosure. Generally, the R group will contain at least about 2 carbon atoms, for example about 3 to about 30 carbon atoms.

The R group can be aliphatic or aromatic such as alkyl, aryl, alkaryl, and alicyclic hydrocarbon groups. Non-limiting examples of useful hydroxy compounds of the formula ROH include, for example, ethyl alcohol, iso-propyl, n-butyl alcohol, amyl alcohol, hexyl alcohol, 2-ethyl-hexyl alcohol, nonyl alcohol, dodecyl alcohol, stearyl alcohol, amyl phenol, octyl phenol, nonyl phenol, methyl cyclohexanol, and alkylated naphthol, etc.

In an aspect, the alcohols, ROH, can be aliphatic alcohols and for example, primary aliphatic alcohols containing at least about 4 carbon atoms. Accordingly, examples of the exemplary monohydric alcohols ROH which can be useful in the present disclosure include, amyl alcohol, 1-octanol, 1-decanol, 1-dodecanol, 1-tetradecanol, 1-hexadecanol, 1-octadecanol, 2-methyl butanol, and 2-methyl-1-propanol, oleyl alcohol, linoleyl alcohol, linolenyl alcohol, phytol, myricyl alcohol, lauryl alcohol, myristyl alcohol, cetyl alcohol, stearyl alcohol and behenyl alcohol.

In another aspect, ROH can be secondary aliphatic alcohols containing at least about 4 carbon atoms. Accordingly, non-limiting examples of secondary aliphatic alcohols include isopropanol, isooctanol, 2-butanol, and methyl isobutyl carbinol (4-methyl-1-pentane-2-ol). Commercial alcohols (including mixtures) are contemplated herein, and these commercial alcohols can comprise minor amounts of alcohols which, although not specified herein, do not detract from the major purposes of this disclosure.

In a further aspect, mixtures of alcohols can be used, including but not limited to mixtures of primary alcohols, mixtures of secondary alcohols, and mixtures of primary/secondary alcohols.

The molar ratio of the hydroxy compound ROH to phosphorus reactant $P_2X_5$ in the reaction can be within the range of from about 1:1 to about 4:1, for example about 3:1. The reaction can be effected simply by mixing the two reactants at an elevated temperature such as temperatures above about 50° C. up to the composition temperature of any of the reactants or the desired product. In an aspect, the temperature can range from about 50° C. to about 150° C., and can be most often below about 100° C. The reaction can be carried out in the presence of a solvent which facilitates temperature control and mixing of the reactants. The solvent can be any inert fluid substance in which either one or both reactants are soluble, or the product is soluble. Such solvents include benzene, toluene, xylene, n-hexane, cyclohexane, naphtha, diethyl ether carbitol, dibutyl ether dioxane, chlorobenzene, nitrobenzene, carbon tetrachloride or chloroform.

The product of the above reaction is acidic, but its chemical constitution is not precisely known. Evidence indicates, however, that the product is a mixture of acidic phosphates comprising predominantly of the mono- and di-esters of phosphoric acid (or thio- or dithiophosphoric acid), the ester group being derived from the alcohol ROH. In an embodiment, the phosphoric acid ester is amyl acid phosphate.

The amine salts of the present disclosure can be prepared by reaction of the above-described phosphoric acid esters such as represented by Formula I with at least one amino compound which can be primary or secondary. In an aspect, the amines which are reacted with the substituted phosphoric acids to form the amine salts are primary hydrocarbyl amines having the general formula:

$$R'NH_2$$

wherein R' can be a hydrocarbyl group containing up to about 150 carbon atoms and will more often be an aliphatic hydrocarbyl group containing from about 4 to about 30 carbon atoms.

In an aspect, the hydrocarbyl amines which are useful in preparing the amine salts of the present disclosure can be primary hydrocarbyl amines containing from about 4 to about 30 carbon atoms in the hydrocarbyl group, and for example from about 8 to about 20 carbon atoms in the hydrocarbyl group. The hydrocarbyl group can be saturated or unsaturated. Representative examples of primary saturated amines are those known as aliphatic primary fatty amines. Typical fatty amines include alkyl amines such as n-hexylamine, n-octylamine, n-decylamine, n-dodecylamine, n-tetradecylamine, n-pentadecylamine, n-hexadecylamine, n-octadecylamine (stearyl amine), etc. These primary amines are available in both distilled and technical grades. While the distilled grade will provide a purer reaction product, the desirable amides and imides will form in reactions with the amines of technical grade. Also suitable are mixed fatty amines.

In another aspect, the amine salts of the phosphorus compound can be those derived from tertiary-aliphatic primary amines having at least about 4 carbon atoms in the alkyl group. For the most part, they can be derived from alkyl amines having a total of less than about 30 carbon atoms in the alkyl group.

Usually the tertiary aliphatic primary amines are monoamines represented by the formula $$R(CH_3)_2CNH_2$$

wherein R can be a hydrocarbyl group containing from one to about 30 carbon atoms. Such amines can be illustrated by tertiary-butyl amine, tertiary-hexyl primary amine, 1-methyl-1-amino-cyclohexane, tertiary-octyl primary amine, tertiary-decyl primary amine, tertiary-dodecyl primary amine, tertiary-tetradecyl primary amine, tertiary-hexadecyl primary amine, tertiary-octadecyl primary amine, tertiary-tetracosanyl primary amine, tertiary-octacosanyl primary amine.

Mixtures of amines are also useful for the purposes of this disclosure. Illustrative of amine mixtures of this type is a mixture of $C_{11}$-$C_{14}$ tertiary alkyl primary amines and a similar mixture of $C_{18}$-$C_{22}$ tertiary alkyl primary amines. The tertiary alkyl primary amines and methods for their preparation are well known to those of ordinary skill in the art and, therefore, further discussion is unnecessary. The tertiary alkyl primary amine useful for the purposes of this disclosure and methods for their preparation are described in U.S. Pat. No. 2,945,749, which is hereby incorporated by reference for its teaching in this regard.

Primary amines in which the hydrocarbon chain comprises olefinic unsaturation also are quite useful. Thus, the R' and R" groups may contain one or more olefinic unsaturation depending on the length of the chain, usually no more than one double bond per 10 carbon atoms. Representative amines are dodecenylamine, myristoleylamine, palmitoleylamine, oleylamine and linoleylamine.

Secondary amines include dialkylamines having two of the above alkyl groups including such commercial fatty secondary amines, and also mixed dialkylamines where R' is a fatty amine and R" may be a lower alkyl group (1-9 carbon atoms) such as methyl, ethyl, n-propyl, i-propyl, butyl, etc., or R" may be an alkyl group bearing other non-reactive or polar substituents (CN, alkyl, carbalkoxy, amide, ether, thioether, halo, sulfoxide, sulfone) such that the essentially hydrocarbon character of the radical is not destroyed. The fatty polyamine diamines include mono-or dialkyl, symmetrical or asymmetrical ethylene diamines, propane diamines (1,2, or 1,3), and polyamine analogs of the above. Suitable polyamines include N-coco-1,3-diaminopropane, N-soyaalkyl trimethylenediamine, N-tallow-1,3-diaminopropane, or N-oleyl-1,3-diaminopropane.

The oil-soluble amine salts can be prepared by mixing the above-described phosphoric acid esters with the above-described amines at room temperature or above. Generally, mixing at room temperature for a period of from up to about one hour is sufficient. The amount of amine reacted with the phosphoric acid ester to form the salts of the disclosure is at least about one equivalent weight of the amine (based on nitrogen) per equivalent of phosphoric acid, and the ratio of equivalents generally is about one.

Methods for the preparation of such amine salts are well known and reported in the literature. See for example, U.S. Pat. Nos. 2,063,629; 2,224,695; 2,447,288; 2,616,905; 3,984,448; 4,431,552; 5,354,484; Pesin et al, Zhurnal Obshchei Khimii, Vol, 31, No. 8, pp. 2508-2515 (1961); and PCT International Application Publication No. WO 87/07638, the disclosures of all of which are hereby incorporated by reference.

Alternatively, the salts can be formed in situ when the acidic phosphoric acid ester is blended with the above-described amines when forming an additive concentrate or the fully formulated composition itself.

The salt of at least one hydrocarbylamine and at least one hydrocarbyl acid phosphate can be present in the disclosed compositions in varying amounts, depending upon specific requirements and applications. Additionally, the salt of at least one hydrocarbylamine and at least one hydrocarbyl acid phosphate used herein should be soluble in a final lubricating composition.

In an embodiment, the ratio of the at least one ash-containing phosphorus compound to at least one ash-free phosphorus compound can range from about 90:10 to about 10:90, for example from about 75:25 to about 25:75, and as a further example can be 50:50. In an another embodiment, the at least one ash-containing phosphorus compound and at least one ash-free phosphorus compound can be present in amounts sufficient to yield a lubricating composition having a phosphorus content ranging from about 250 ppm to about 1000 ppm.

The compositions disclosed herein can optionally contain additives, such as dispersants, ash-containing detergents, ashless detergents, overbased detergents, pour point depressing agents, viscosity index modifiers, extreme pressure agents, rust inhibitors, antioxidants, corrosion inhibitors, anti-foam agents, titanium compounds, titanium complexes, organic soluble molybdenum compounds, organic soluble molybdenum complexes, boron-containing compounds, boron-containing complexes, tungsten-containing compounds, tungsten-containing complexes, and combinations thereof. In an aspect, the compositions can comprise various levels of at least one molybdenum-containing compound depending on the needs and requirements of the application. In an embodiment, the compositions disclosed can be essentially free of organic and inorganic friction modifiers.

Base oils suitable for use in formulating the disclosed compositions can be selected from any of the synthetic or mineral oils or mixtures thereof. Mineral oils include animal oils and vegetable oils (e.g., castor oil, lard oil) as well as other mineral lubricating oils such as liquid petroleum oils and solvent treated or acid-treated mineral lubricating oils of the paraffinic, naphthenic or mixed paraffinic-naphthenic types. Oils derived from coal or shale are also suitable. Further, oils derived from a gas-to-liquid process are also suitable.

The base oil can have any desired viscosity that is suitable for the intended purpose. Suitable automotive oils include multi-grade oils such as SAE 0W-20, SAE 0W-30, SAE 5W-20, SAE 5W-30, SAE 10W-30, SAE 10W-40, SAE 30, 40 and 50, and the like. Suitable automotive oils can also include multi-grade oils such as 15W-40, 20W-50, 75W-140, 80W-90, 85W-140, 85W-90, and the like.

Non-limiting examples of synthetic oils include hydrocarbon oils such as polymerized and interpolymerized olefins (e.g., polybutylenes, polypropylenes, propylene isobutylene copolymers, etc.); polyalphaolefins such as poly(1-hexenes), poly-(1-octenes), poly(1-decenes), etc. and mixtures thereof; alkylbenzenes (e.g., dodecylbenzenes, tetradecylbenzenes, di-nonylbenzenes, di-(2-ethylhexyl)benzenes, etc.); polyphenyls (e.g., biphenyls, terphenyl, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl moieties have been modified by esterification, etherification, etc., constitute another class of known synthetic oils that can be used. Such oils are exemplified by the oils prepared through polymerization of ethylene oxide or propylene oxide, the alkyl and aryl ethers of these polyoxyalkylene polymers (e.g., methyl-polyisoprylene glycol ether having an average molecular weight of about 1000, diphenyl ether of polyethylene glycol having a molecular weight of about 500-1000, diethyl ether of polypropylene glycol having a molecular weight of about 1000-1500, etc.) or mono- and polycarboxylic esters thereof, for example, the acetic acid esters, mixed $C_{3-8}$ fatty acid esters, or the $C_{13}$ Oxo acid diester of tetraethylene glycol.

Another class of synthetic oils that can be used includes the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_{5-12}$ monocarboxylic acids and polyols and polyol ethers such as neopentyl glycol, trimethylol propane, pentaerythritol, dipentaerythritol, tripentaerythritol, etc.

Hence, the base oil used which can be used to make the compositions as described herein can be selected from any of the base oils in Groups I-V as specified in the American Petroleum Institute (API) Base Oil Interchangeability Guidelines. Such base oil groups are as follows:

Group I contain less than 90% saturates and/or greater than 0.03% sulfur and have a viscosity index greater than or equal to 80 and less than 120; Group II contain greater than or equal to 90% saturates and less than or equal to 0.03% sulfur and have a viscosity index greater than or equal to 80 and less than 120; Group III contain greater than or equal to 90% saturates and less than or equal to 0.03% sulfur and have a viscosity index greater than or equal to 120; Group IV are polyalphaolefins (PAO); and Group V include all other basestocks not included in Group I, II, III or IV.

The test methods used in defining the above groups are ASTM D2007 for saturates; ASTM D2270 for viscosity index; and one of ASTM D2622, 4294, 4927 and 3120 for sulfur.

Group IV basestocks, i.e. polyalphaolefins (PAO) include hydrogenated oligomers of an alpha-olefin, the most important methods of oligomerisation being free radical processes, Ziegler catalysis, and cationic, Friedel-Crafts catalysis.

The polyalphaolefins typically have viscosities in the range of 2 to 100 cSt at 100° C., for example 4 to 8 cSt at 100° C. They can, for example, be oligomers of branched or straight chain alpha-olefins having from about 2 to about 30 carbon atoms, non-limiting examples include polypropenes, polyisobutenes, poly-1-butenes, poly-1-hexenes, poly-1-octenes and poly-1-decene. Included are homopolymers, interpolymers and mixtures.

Regarding the balance of the basestock referred to above, a "Group I basestock" also includes a Group I basestock with which basestock(s) from one or more other groups can be admixed, provided that the resulting admixture has characteristics falling within those specified above for Group I basestocks.

Exemplary basestocks include Group I basestocks and mixtures of Group II basestocks with Group I bright stock.

Basestocks suitable for use herein can be made using a variety of different processes including but not limited to distillation, solvent refining, hydrogen processing, oligomerisation, esterification, and re-refining.

The base oil can be an oil derived from Fischer-Tropsch synthesized hydrocarbons. Fischer-Tropsch synthesized hydrocarbons can be made from synthesis gas containing $H_2$ and CO using a Fischer-Tropsch catalyst. Such hydrocarbons typically require further processing in order to be useful as the base oil. For example, the hydrocarbons can be hydroisomerized using processes disclosed in U.S. Pat. Nos. 6,103,099 or 6,180,575; hydrocracked and hydroisomerized using processes disclosed in U.S. Pat. Nos. 4,943,672 or 6,096,940; dewaxed using processes disclosed in U.S. Pat. No. 5,882,505; or hydroisomerized and dewaxed using processes disclosed in U.S. Pat. Nos. 6,013,171; 6,080,301; or 6,165,949.

Unrefined, refined and rerefined oils, either mineral or synthetic (as well as mixtures of two or more of any of these) of the type disclosed hereinabove can be used in the base oils. Unrefined oils are those obtained directly from a mineral or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives, contaminants, and oil breakdown products.

According to various embodiments, there is a method of reducing boundary friction of a fluid between surfaces. The method of reducing boundary friction of a fluid between surfaces can comprise providing to the surfaces a lubricating composition comprising a major amount of a base oil; and a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate. In an aspect, the method can be achieved essentially in the absence of organic and inorganic friction modifiers.

According to various embodiments, there is also disclosed a method of reducing thin-film friction of a fluid between surfaces. The method of reducing thin-film friction can comprise providing to the fluid a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate. In an aspect, the method can be achieved essentially in the absence of organic and inorganic friction modifiers.

Additionally, there is also disclosed a method of increasing fuel efficiency in a vehicle. The method of increasing fuel efficiency in a vehicle can comprise providing to the vehicle a lubricating composition comprising a major amount of a base oil; and a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate. In an aspect, the method can be achieved essentially in the absence of organic and inorganic friction modifiers.

According to various embodiments, there is further disclosed a method of lubricating at least one moving part of a machine. The method of lubricating at least one moving part of a machine can comprise contacting at least one moving part with a lubricating composition comprising a major amount of a base oil; and a minor amount of an a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate. In an aspect, the method can be achieved essentially in the absence of organic and inorganic friction modifiers.

The machine in the disclosed methods can be selected from the group consisting of spark ignition and compression-ignition internal combustion engines, including diesel engines, marine engines, rotary engines, turbine engines, locomotive engines, propulsion engines, aviation piston engines, stationary power generation engines, continuous power generation engines, and engines comprising silver parts. Moreover, the at least one moving part can be chosen from a gear, piston, bearing, rod, spring, camshaft, crankshaft, rotors, and the like.

In another embodiment, there is disclosed a method for improving wear protection in a vehicle. The method for improving wear protection in a vehicle can comprise providing to the vehicle a lubricating composition comprising a major amount of a base oil; and a minor amount of a minor amount of an additive composition comprising (i) at least one ash-containing phosphorus compound prepared by a primary or secondary alcohol or mixtures thereof, and (ii) a salt of at least one hydrocarbylamine and at least one hydrocarbyl acid phosphate. In an aspect, the method can be achieved essentially in the absence of organic and inorganic friction modifiers.

In yet another embodiment, there is disclosed an engine, transmission, or gear set lubricated with the disclosed lubricating composition.

The lubricating composition can be any composition that would be effective in lubricating a machine. In an aspect, the composition is selected from the group consisting of medium speed diesel engine oils, passenger car motor oils, and heavy duty diesel engine oils.

EXAMPLES

The following examples are illustrative of the invention and its advantageous properties. In these examples, as well as elsewhere in this application, all parts and percentages are by weight unless otherwise indicated. It is intended that these examples are being presented for the purpose of illustration only and are not intended to limit the scope of the invention disclosed herein.

Lubricating compositions comprising a metal dihydrocarbyl dithiophosphate salt alone, or in combination with an oil-soluble amine salt of a phosphoric acid ester, were tested for their ability to protect against wear and to reduce boundary friction and thin-film friction. The following examples show that when a metal dihydrocarbyl dithiophosphate salt and an oil-soluble amine salt of a phosphoric acid ester are formulated into a lubricating composition, such as an engine oil, the resultant composition demonstrates reduced frictional characteristics, such as reduced boundary friction and reduced thin-film friction, while maintaining satisfactory wear protection. The examples also show that this characteristic is unique when compared to lubricating compositions comprising a metal dihydrocarbyl dithiophosphate salt alone.

In this example, ZDDP (HiTEC 7169®, available from Afton Chemical Corp., Richmond, Va.) was blended/mixed/combined with various base oils to form two lubricating compositions (Examples A and B). The same ZDDP compound was blended/mixed/combined with an oleylamine salt of amyl acid phosphate in various base oils to form two lubricating compositions (Examples C and D). The oleylamine used was Armeen® OL, available from Azko Nobel Chemical, Chicago, Ill.

The boundary friction coefficients of Examples A through D were determined using a high frequency reciprocating rig (HFRR) as described in SAE paper 961142 (January 1996), the disclosure of which is hereby incorporated by reference. The HFRR also measured the wear produced on reciprocating metal surfaces lubricated by a lubricating composition, such as a fuel, the result of which is the HFRR wear scar value. The thin-film friction coefficients of Examples A through D were measured using the methods disclosed in SAE 2003-01-1972 and SAE 961142, the disclosures of which are hereby incorporated by reference. The results of tests are shown in Table 1 below.

TABLE 1

| | P in oil (ppm) | Boundary Friction Coefficient at 100° C. | Thin-Film Friction Coefficient | HFRR Wear Scar Value |
|---|---|---|---|---|
| A | 467 | 0.140 | 0.066 | 12 |
| B | 459 | 0.142 | 0.070 | 19 |
| C | 536 | 0.090 | 0.058 | 1 |
| D | 542 | 0.091 | 0.061 | 0 |

As shown in Table 1, Examples A through D included approximately uniform phosphorous concentrations. It is clear from the results above that the lubricating compositions of the present invention (Examples C and D) unexpectedly possess reduced boundary and thin-film frictional characteristics as compared to compositions including ZDDP alone. For instance, Examples C and D demonstrated low boundary friction coefficients (0.090 and 0.091, respectively) and low thin-film friction coefficients (0.058 and 0.061, respectively). In comparison, Examples A and B (including ZDDP alone) demonstrated much higher boundary friction coefficients (0.140 and 0.142, respectively) and higher thin-film friction coefficients (0.066 and 0.070, respectively). One of ordinary skill in the art would understand that the lower the boundary friction and thin-film friction coefficients, the better the fuel economy. Thus, a machine lubricated with inventive Examples C and D would demonstrate improved fuel economy as compared to a machine lubricated with comparative Examples A and B.

Inventive Examples C and D also demonstrated low HFRR wear scar values (1 and 0, respectively), whereas Comparative Examples A and B demonstrated much higher HFRR wear scar values (12 and 19, respectively.) One skilled in the art would know that the lower the HFRR wear scar value, the better the wear protection. Thus, inventive Examples C and D also demonstrate improved wear protection as compared to Examples A and B.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method of reducing boundary friction and thin film friction of a lubricating fluid in an engine, said method comprising:

providing to the engine a lubricating composition comprising: a major amount of a base oil; and a minor amount of an additive composition comprising (i) at least metal dihydrocarbyl dithiophosphate compound prepared by a secondary alcohol, and (ii) a phosphate salt consisting essentially of a salt of at least one hydrocarbylamine and at least one sulfur-free hydrocarbyl acid phosphate, wherein the ratio of (i) to (ii) ranges from about 90:10 to about 10:90, wherein (i) and (ii) are present in amounts sufficient to yield an engine lubricating composition having a phosphorus content ranging from about 250 ppm to about 1000 ppm, and reduced boundary friction and thin film friction compared to the same lubricating composition devoid of components (i) and (ii) in the claimed ratio.

2. The method of claim 1, wherein the at least one hydrocarbyl acid phosphate is selected from the group consisting of monohydrocarbyl phosphates, dihydrocarbyl phosphates, trihydrocarbyl phosphates, and mixtures thereof.

3. The method of claim 1, wherein the at least one hydrocarbyl acid phosphate comprises a mixture of monohydrocarbyl and dihydrocarbyl phosphates.

4. The method of claim 1, wherein the at least one hydrocarbyl acid phosphate is amyl acid phosphate.

5. The method of claim 1, wherein the at least one hydrocarbylamine is linear or branched, saturated or unsaturated, and comprises from about 10 to about 30 carbon atoms.

6. The method of claim 1, wherein the lubricating composition is essentially free of organic and inorganic friction modifiers.

7. The method of claim 1, further comprising at least one additive selected from the group consisting of phosphorus-containing compounds, ash-containing detergents, ashless detergents, overbased detergents, pour point depressants, viscosity index improvers, extreme pressure agents, rust inhibitors, antioxidants, corrosion inhibitors, anti-foam agents, titanium compounds, titanium complexes, organic soluble molybdenum compounds, organic soluble molybdenum complexes, boron-containing compounds, and boron-containing complexes.

8. The method of claim 1, wherein the base oil comprises one or more of a member selected from the group consisting of: a Group I base oil, a Group II base oil, a Group III base oil, a Group IV base oil, and a Group V base oil.

9. The method of claim 1, wherein the metal dihydrocarbyl dithiophosphate compound is a zinc dihydrocarbyl dithiophosphate prepared from a secondary alcohol.

10. The method of claim 1, wherein the engine is selected from the group consisting of spark ignition and compression-ignition internal combustion engines.

11. The method of claim 10, wherein the engine is selected from the group consisting of diesel engines, marine engines, rotary engines, turbine engines, locomotive engines, propulsion engines, aviation piston engines, stationary power generation engines, and continuous power generation engines.

* * * * *